US008290722B2

(12) United States Patent
Schuster et al.

(10) Patent No.: US 8,290,722 B2
(45) Date of Patent: Oct. 16, 2012

(54) METHOD FOR DETERMINING REFRIGERANT CHARGE

(75) Inventors: Don A. Schuster, Lindale, TX (US); Sathish R. Das, Indianapolis, IN (US); Frederick J. Keller, Jr., Martinsville, IN (US)

(73) Assignee: Carrier Corporation, Farmington, CT (US)

( * ) Notice: Subject to any disclaimer, the term of this patent is extended or adjusted under 35 U.S.C. 154(b) by 550 days.

(21) Appl. No.: 12/519,640

(22) PCT Filed: Dec. 20, 2006

(86) PCT No.: PCT/US2006/048689

§ 371 (c)(1),
(2), (4) Date: Dec. 4, 2009

(87) PCT Pub. No.: WO2008/079111

PCT Pub. Date: Jul. 3, 2008

(65) Prior Publication Data

US 2010/0088046 A1 Apr. 8, 2010

(51) Int. Cl.

| | |
|---|---|
| ***G01F 22/00*** | (2006.01) |
| ***G06F 19/00*** | (2011.01) |
| ***G06F 17/40*** | (2006.01) |

(52) U.S. Cl. ..... 702/55; 62/125; 73/865.8; 73/866.3; 340/612; 340/679; 702/187; 702/189; 708/200

(58) Field of Classification Search ..... 62/56, 115, 62/125; 73/432.1, 865.8, 865.9, 866.3; 340/500, 340/540, 603, 612, 614, 626, 679; 702/1, 702/33, 34, 50, 55, 127, 182, 183, 187, 189; 708/100, 105, 200

See application file for complete search history.

(56) References Cited

U.S. PATENT DOCUMENTS

| | | | | |
|---|---|---|---|---|
| 2,883,255 | A * | 4/1959 | Anderson | 346/34 |
| 3,321,613 | A * | 5/1967 | Searle | 702/182 |
| 4,114,448 | A | 9/1978 | Merritt | |
| 4,304,126 | A | 12/1981 | Yelke | |
| 4,325,223 | A | 4/1982 | Cantley | |
| 4,381,549 | A | 4/1983 | Stamp, Jr. et al. | |
| 4,429,578 | A | 2/1984 | Darrel et al. | |
| 4,510,576 | A | 4/1985 | MacArthur et al. | |

(Continued)

FOREIGN PATENT DOCUMENTS

| | | |
|---|---|---|
| EP | 0159281 | 10/1985 |
| EP | 0289369 | 11/1988 |
| EP | 0308160 | 3/1989 |
| EP | 0396029 | 11/1990 |
| EP | 0409000 | 1/1991 |

(Continued)

OTHER PUBLICATIONS

International Search Report and Written Opinion mailed Oct. 23, 2007 (7 pgs.).

*Primary Examiner* — Edward Cosimano
(74) *Attorney, Agent, or Firm* — Cantor Colburn LLP

(57) ABSTRACT

A method for determining the adequacy of the refrigerant charge in an air conditioning system based upon both the instantaneous degree of subcooling present in the liquid refrigerant in the refrigerant line at a location whereat only liquid refrigerant is present and a calculated average subcooling value based upon accumulated instantaneous subcooling values. The adequacy of the refrigerant charge in the system may be indicated by an alert indicating "check charge" or by a series of lights including a first indicator light indicating that the refrigerant charge is low, a second indicator light indicating that the refrigerant charge is high, and a third indicator light indicating that the refrigerant charge is correct.

14 Claims, 6 Drawing Sheets

U.S. PATENT DOCUMENTS 4,541,284 A 9/1985 Guagliumi et al.
4,546,616 A 10/1985 Drucker
4,561,261 A 12/1985 Kornrumpf et al.
4,624,112 A 11/1986 Proctor
4,677,830 A 7/1987 Sumikawa et al.
4,745,519 A 5/1988 Breidegam
4,798,055 A 1/1989 Murray et al.
4,805,416 A 2/1989 Manz et al.
4,829,777 A 5/1989 Matsuoka et al.
4,841,734 A 6/1989 Torrence
4,856,288 A 8/1989 Weber
4,982,576 A 1/1991 Proctor et al.
5,016,472 A 5/1991 Amrhein et al.
5,046,322 A 9/1991 Bulla et al.
5,057,965 A 10/1991 Wilson
5,079,930 A 1/1992 Beaverson et al.
5,156,012 A 10/1992 Kuribara et al.
5,186,012 A 2/1993 Czachorski et al.
5,206,963 A 5/1993 Wiens
5,214,918 A 6/1993 Oguni et al.
5,228,304 A 7/1993 Ryan
5,239,865 A 8/1993 Salzer et al.
H1226 H 9/1993 VanReenen et al.
5,241,833 A 9/1993 Ohkoshi
5,248,168 A 9/1993 Chichester et al.
5,251,453 A 10/1993 Stanke et al.
5,295,360 A 3/1994 Olds et al.
5,317,903 A 6/1994 McClelland et al.
5,341,649 A 8/1994 Nevitt et al.
5,354,103 A 10/1994 Torrence et al.
5,362,530 A 11/1994 Kitami et al.
5,374,084 A 12/1994 Potokar
5,381,669 A 1/1995 Bahel et al.
5,406,980 A 4/1995 Allread et al.
5,413,147 A 5/1995 Moreiras et al.
5,423,189 A 6/1995 Nicol et al.
5,425,558 A 6/1995 Dennany, Jr.
5,430,692 A 7/1995 Grupp et al.
5,463,377 A 10/1995 Kronberg
5,464,042 A 11/1995 Haunhorst
5,468,028 A 11/1995 Olson
5,474,336 A 12/1995 Hoff et al.
5,481,884 A * 1/1996 Scoccia ..... 62/129
5,540,463 A 7/1996 Potokar
5,560,213 A * 10/1996 Wieszt ..... 62/125
5,586,445 A 12/1996 Bessler
5,647,222 A * 7/1997 Sarakinis ..... 62/129
5,694,778 A 12/1997 Wilson
5,752,726 A 5/1998 Fixemer
5,807,332 A 9/1998 Augustine et al.
5,834,943 A 11/1998 Miller
5,860,286 A 1/1999 Tulpule
5,868,437 A 2/1999 Teague
5,961,157 A 10/1999 Baron et al.
5,987,903 A 11/1999 Bathla
6,012,743 A 1/2000 Godeau et al.
6,045,742 A 4/2000 McGrevy
6,101,820 A 8/2000 Cheballah
6,155,612 A 12/2000 Szabo
6,161,394 A 12/2000 Alsenz
6,179,214 B1 1/2001 Key et al.
6,209,338 B1 * 4/2001 Thatcher, Jr. ..... 62/292
6,302,654 B1 10/2001 Millet et al.
6,308,523 B1 10/2001 Scaringe
6,324,854 B1 12/2001 Jayanth
6,330,802 B1 * 12/2001 Cummings et al. ..... 62/129
6,354,332 B1 3/2002 Burkhardt et al.
6,382,678 B1 5/2002 Field et al.
6,442,953 B1 9/2002 Trigiani et al.
6,460,354 B2 10/2002 Yabuki et al.
6,463,747 B1 10/2002 Temple
6,470,695 B2 10/2002 Gong
6,481,756 B1 11/2002 Field et al.
6,497,435 B1 12/2002 Luft et al.
6,546,823 B1 4/2003 Veit
6,550,341 B2 4/2003 van Schoor et al.
6,553,774 B1 4/2003 Ishio et al.
6,571,566 B1 6/2003 Temple et al.
6,594,554 B1 7/2003 Seem et al.
6,658,373 B2 12/2003 Rossi et al.
6,708,508 B2 * 3/2004 Demuth et al. ..... 62/129
6,735,964 B2 5/2004 Perkovich et al.
6,758,051 B2 7/2004 Jayanth et al.
6,769,258 B2 8/2004 Pierson
6,843,070 B1 1/2005 Suharno
6,868,678 B2 3/2005 Mei et al.
6,964,173 B2 11/2005 Dobmeier et al.
6,981,384 B2 * 1/2006 Dobmeier et al. ..... 62/149
7,079,967 B2 7/2006 Rossi et al.
7,146,290 B2 12/2006 Triginai et al.
7,146,819 B2 * 12/2006 Demuth et al. ..... 62/129
7,386,985 B2 * 6/2008 Concha et al. ..... 62/77
7,752,855 B2 * 7/2010 Matsuoka et al. ..... 62/149
2002/0024218 A1 2/2002 Manuli
2002/0083723 A1 * 7/2002 Demuth et al. ..... 62/129
2002/0096209 A1 7/2002 Danielson et al.
2002/0112490 A1 * 8/2002 Gong ..... 62/149
2002/0121100 A1 9/2002 Yabuki et al.
2002/0139128 A1 10/2002 Suzuki et al.
2002/0141877 A1 10/2002 Jayanth et al.
2002/0182005 A1 12/2002 Milhas
2003/0055603 A1 * 3/2003 Rossi et al. ..... 702/185
2003/0089119 A1 5/2003 Pham et al.
2003/0172665 A1 9/2003 Matsuoka et al.
2003/0182950 A1 10/2003 Mei et al.
2003/0226367 A1 12/2003 Palmer et al.
2004/0111239 A1 * 6/2004 Rossi et al. ..... 702/183
2004/0159114 A1 * 8/2004 Demuth et al. ..... 62/129
2005/0204756 A1 * 9/2005 Dobmeier et al. ..... 62/149
2005/0235755 A1 10/2005 Hindman
2007/0125102 A1 * 6/2007 Concha et al. ..... 62/149
2008/0209926 A1 * 9/2008 Matsuoka et al. ..... 62/129
2010/0089076 A1 * 4/2010 Schuster et al. ..... 62/77

FOREIGN PATENT DOCUMENTS

EP 0453302 10/1991
EP 0529758 3/1993
EP 0550263 7/1993
EP 0760069 3/1997
EP 0843794 5/1998
EP 0918182 5/1999
EP 1238838 9/2002
EP 1337825 8/2003
FR 2667570 4/1992
GB 2274695 8/1994
JP 62218748 9/1987
JP 62261845 11/1987
JP 63302238 12/1988
JP 2110268 4/1990
JP 2195165 8/1990
JP 455671 2/1992
JP 4190062 7/1992
JP 4273941 9/1992
JP 599475 4/1993
JP 5231754 9/1993
JP 5256543 10/1993
JP 755299 3/1995
JP 868576 3/1996
JP 8261542 10/1996
JP 8261543 10/1996
JP 20009048 1/2000
JP 2000154954 6/2000
JP 200132884 2/2001
JP 2001141279 5/2001
WO WO-9320376 10/1993
WO WO-9530106 11/1995
WO WO-9530107 11/1995
WO WO-9533157 12/1995
WO WO-9617202 6/1996
WO WO-9712167 4/1997
WO WO-9713994 4/1997
WO WO-9713995 4/1997
WO WO-9747908 12/1997
WO WO-0045053 8/2000
WO WO-0123794 4/2001

* cited by examiner

METHOD FOR DETERMINING REFRIGERANT CHARGE

BACKGROUND OF THE INVENTION

This invention relates generally to subcritical vapor compression systems that use thermostatic expansion valve devices to control compressor suction superheat and, more particularly, to a method and apparatus for determining refrigerant charge adequacy in an air conditioning system.

Maintaining proper refrigerant charge level is essential to the reliable and efficient operation of an air conditioning system. Improper charge level, whether in deficit or in excess, can cause premature compressor failure and diminish system efficiency. An over-charge in the system results in compressor flooding with liquid refrigerant, and/or excessive discharge pressure, which, in turn, may be damaging to the motor and mechanical components. Inadequate refrigerant charge can lead to diminished system capacity and efficiency and potential compressor damage. Low charge also causes reduced refrigerant mass flow, decreased refrigerant pressure entering the compressor and/or an increase in refrigerant temperature entering and leaving the compressor, all of which may cause thermal over-load of the compressor. Thermal over-load of the compressor can cause degradation of the motor winding insulation, thereby bringing about premature motor failure. Additional effects of low refrigerant charge can include diminished or total loss of lubrication of mechanical components, which can lead to catastrophic compressor failure.

Charge adequacy has traditionally been checked manually by trained service technicians using pressure measurements, temperature measurements and a pressure to refrigerant temperature relationship chart for the particular refrigerant resident in the system. For refrigerant vapor compression systems which use a thermal expansion valve (TXV), the superheat of the refrigerant entering the compressor is normally regulated at a fixed value, while the amount of subcooling of the refrigerant exiting the condenser may vary. Even so, in such systems, the "subcooling method" is customarily used as an indicator for charge level. In this method, the amount of subcooling, defined as the saturated refrigerant temperature at the refrigerant pressure at the outlet of the condenser coil for the refrigerant in use, a.k.a. the refrigerant condensing temperature, minus the actual refrigerant temperature measured at the outlet of the condenser coil, is determined and compared to the manufacturer's published subcooling value for the particular air conditioning or heat pump system. Generally, an acceptable subcooling value for a subcritical refrigerant vapor compression system operating as a residential or light commercial air conditioner lies between 10 and 15° F.

Typically, the technician uses a pressure gauge to measure the refrigerant pressure at the condenser outlet and a temperature gauge to measure the refrigerant line temperature at a point downstream with respect to refrigerant flow of the condenser coil and upstream with respect to refrigerant flow of the expansion valve, generally near the exit of the condenser. With these refrigerant pressure and temperature measurements, the technician then refers to the pressure to temperature relationship chart for the refrigerant in use to determine the saturated refrigerant temperature at the measured pressure and calculates the amount of cooling actually present at the current operating conditions, that is outdoor temperature, indoor temperature, humidity, indoor airflow and the like. If the measured amount of cooling lies within the range of acceptable levels specified by the manufacturer at corresponding ambient and operating conditions, the technician considers the system properly charged. If not, the technician will adjust the refrigerant charge by either adding a quantity of refrigerant to the system or draining a quantity of refrigerant from the system, as appropriate. Methods for determining the refrigerant charge level in an air conditioning system are disclosed in U.S. Pat. Nos. 5,239,865; 5,987,903; 6,101,820; and 6,571,566.

As operating conditions may vary widely from day to day, the particular amount of cooling measured by the field service technician at any given time may not be truly reflective of the amount of subcooling present during "normal" operation of the system. Thus, this charging procedure is also an empirical, time-consuming, and a trial-and-error process subject to human error. Therefore, the technician may charge the system with an amount of refrigerant that is not the optimal amount charge for "normal" operating conditions, but rather with an amount of refrigerant that is merely within an acceptable tolerance of the optimal amount of charge under the operating conditions at the time the system is charged. This results in human error added to the charging of the system with refrigerant. Therefore, it is desirable to provide a method and device for automatically indicating the status of the refrigerant charge within an operating system over a wide range of actual operating conditions. It is also desirable to provide a visual interface in association with such a device to indicate whether or not the system is properly charged.

SUMMARY OF THE INVENTION

It is an object of the invention to provide a method for determining the adequacy of refrigerant charge in a subcritical refrigerant vapor compression system.

It is an object of one aspect of the invention to provide a method for determining the adequacy of refrigerant charge in a subcritical refrigerant vapor compression system taking both instantaneous subcooling values and average subcooling values into consideration.

A method is provided for determining the adequacy of refrigerant charge in a subcritical refrigerant vapor compression system having a compressor, a condenser coil, an expansion device and an evaporator coil connected in serial relationship in refrigerant flow circuit. The method includes the steps of: sensing the pressure of the refrigerant at a location in the refrigerant flow circuit whereat the refrigerant is normally in a liquid only state with the system operating and generating a first signal indicative of the sensed refrigerant pressure; sensing the temperature of the refrigerant at a location in the refrigerant flow circuit whereat the refrigerant is in a liquid only state and generating a second signal indicative of the sensed refrigerant temperature; calculating in real-time a value for the degrees of subcooling present based upon the sensed refrigerant pressure and the sensed refrigerant temperature; storing the calculated instantaneous value for the degrees of subcooling in a dedicated data location associated with the sensed refrigerant temperature; accumulating the calculated instantaneous value for the degrees of subcooling associated with each respective sensed refrigerant temperature within the respective data location associated with the respective sensed refrigerant temperature; calculating an average value for the degrees of subcooling present based upon the accumulated instantaneous values for the degrees of subcooling; determining a system refrigerant charge status based upon a consideration of both the instantaneous value for the degree of subcooling and the average value for the degree of subcooling; and outputting an indication of a refrigerant charge status.

The step of sensing the pressure of the refrigerant at a location in the refrigerant flow circuit whereat the refrigerant is in a liquid state only may include sensing the pressure of the refrigerant leaving the condenser coil and the step of sensing the temperature of the refrigerant at a location in the refrigerant flow circuit whereat the refrigerant is in a liquid state only may include sensing the temperature of the refrigerant at a location downstream with respect to refrigerant flow of the condenser coil and upstream with respect to refrigerant flow of the expansion device.

In an embodiment, the step of determining a system refrigerant charge status includes the steps of determining whether the instantaneous subcooling value is within a first degrees of tolerance of a first target subcooling value; and determining whether the average subcooling value is within a second degrees of tolerance of a second target subcooling value. The first degrees of tolerance may exceed the second degrees of tolerance, and the first subcooling target and the second subcooling target may be the same degrees of subcooling.

In an embodiment of the method of the invention, the step of outputting an indication of refrigerant charge status may comprise indicating that the refrigerant charge should be checked. A indication that the refrigerant charge should be checked may be outputted if both the instantaneous subcooling value is greater than an instantaneous subcooling target value plus a first degrees of tolerance and the average subcooling value is greater than an average subcooling target value plus a second degrees of tolerance, or if the average subcooling value is less than the average subcooling target value minus the second degrees of tolerance.

In an embodiment of the method of the invention, the step of outputting an indication of refrigerant charge status may include the step of outputting an indication that the refrigerant charge status is correct if both the instantaneous subcooling value is greater than an instantaneous subcooling target value minus a first degrees of tolerance and less than the instantaneous subcooling target value plus the first degrees of tolerance and the average subcooling value is greater than an average subcooling target value minus a second degrees of tolerance and less than the average subcooling target value plus the second degrees of tolerance. The step of outputting an indication of refrigerant charge status may also include the step of outputting an indication that the refrigerant charge status is correct if the average subcooling value is greater than an average subcooling target value minus a second degrees of tolerance and less than the average subcooling target value plus a second degrees of tolerance, and the instantaneous subcooling value is either not stable or not available.

The step of outputting an indication of refrigerant charge status may include the step of outputting an indication that the refrigerant charge status is low if the instantaneous subcooling value is less than an instantaneous subcooling target value minus a first degrees of subcooling or if the average subcooling value is less than an average subcooling target value minus a second degrees of tolerance. The step of outputting an indication of refrigerant charge status may include the step of outputting an indication that the refrigerant charge status is high if the instantaneous subcooling value is greater than an instantaneous subcooling target value plus a first degrees of subcooling or if the average subcooling value is greater than an average subcooling target value plus a second degrees of tolerance.

BRIEF DESCRIPTION OF THE DRAWINGS

For a further understanding of these and objects of the invention, reference will be made to the following detailed description of the invention which is to be read in connection with the accompanying drawing, wherein.

DESCRIPTION OF THE PREFERRED EMBODIMENT

Figure 1:
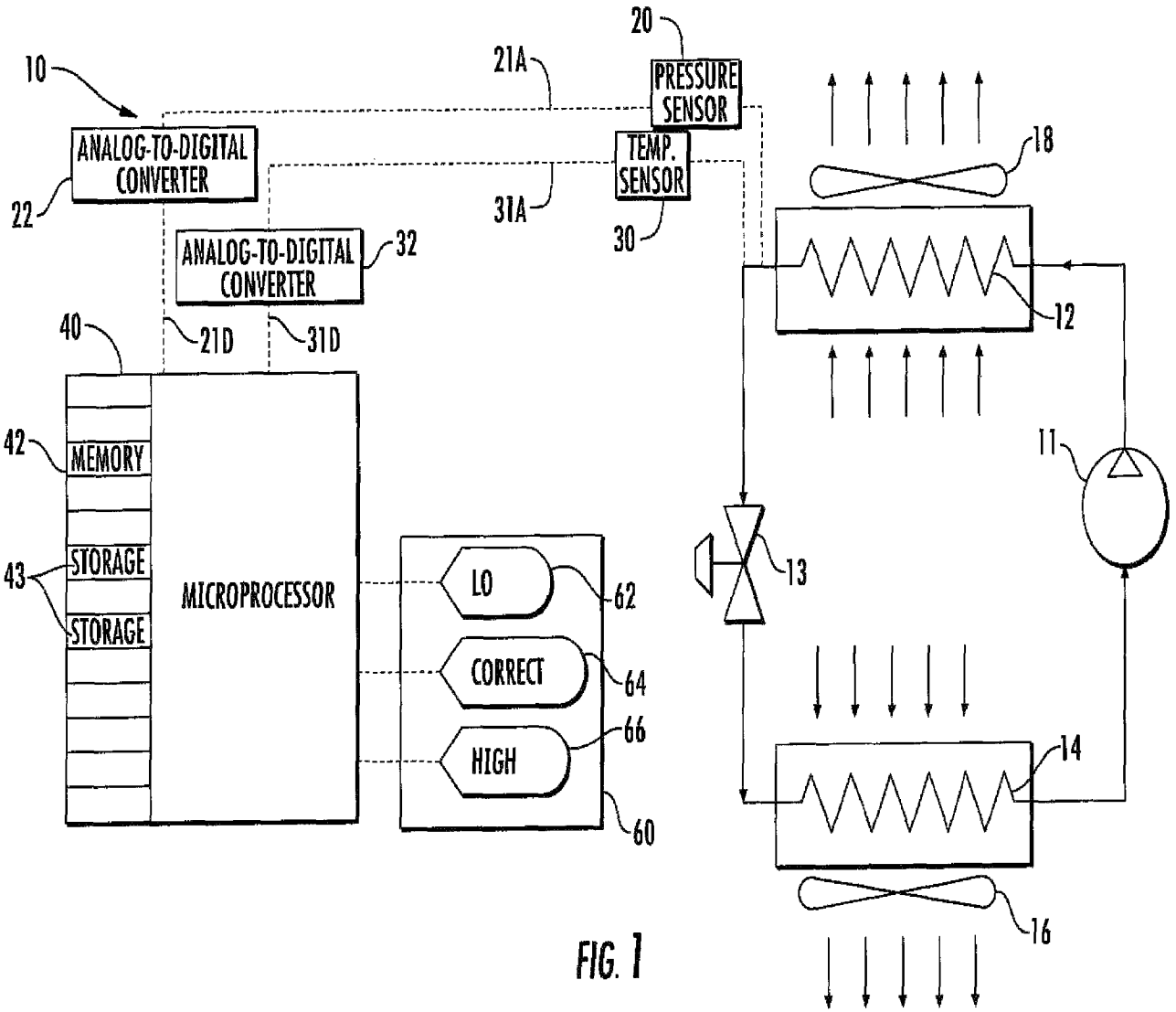
FIG. 1 is a schematic illustration of an first exemplary embodiment of the present invention.

Referring now to FIG. 1, the invention is shown generally as incorporated into a refrigerant vapor compression air conditioning system 10 having a compressor 11, a condenser coil 12, an expansion device 13 and an evaporator coil 14 connected in serial relationship in refrigerant flow communication in a conventional manner via refrigerant lines forming a refrigerant flow circuit. In operation, the refrigerant, for example R12, R22, R134a, R404A, R410A, R407C, R717 or other compressible fluid, circulating through the refrigerant circuit passes through the evaporator coil 14 in the evaporator in heat exchange relationship with indoor air being passed over the evaporator coil 14 by the evaporator fan 16. As the indoor air passes through the evaporator and over the evaporator coil 14, the refrigerant absorbs the heat in the indoor air passing over the evaporator coil, thereby cooling the air and evaporating the refrigerant. The cooled air is circulated by the fan 16 back into the indoor area to be cooled.

After evaporation, the refrigerant vapor is drawn through the refrigerant circuit back to the compressor 11 wherein the refrigerant vapor is pressurized. The resulting hot, high-pressure vapor is circulated through the refrigerant circuit to the condenser wherein it passes through the condenser coil 12 in heat exchange relationship with ambient temperature outdoor air being passed over the condenser coil 12 by the condenser fan 18. As the outdoor air passes through the condenser over the condenser coil 12, the refrigerant rejects heat to the outdoor air passing over, thereby heating the air and condensing the high pressure refrigerant vapor to a high pressure liquid refrigerant. The high pressure liquid refrigerant leaving the condenser passes on through the refrigerant circuit traversing the expansion valve 13 wherein the high pressure refrigerant liquid is expanded to a lower temperature, lower pressure liquid, typically to a saturated liquid refrigerant before it enters the evaporator coil 14.

It should be understood that the expansion device 13 may be a valve such as a thermostatic expansion valve (TXV) or an electronic expansion valve (DCV) which regulates the amount of liquid refrigerant entering the evaporator coil 14 in response to the superheat condition of the refrigerant entering the compressor 11. It is also to be understood that the invention is equally applicable for use in association with other refrigerant vapor compression systems such as heat pump systems. In a heat pump, during cooling mode, the process is identical to that as described hereinabove. In the heating mode, the cycle is reversed with the condenser and evaporator of the cooling mode acting as an evaporator and condenser, respectively.

A pair of sensors 20 and 30 is provided in operative association with the refrigerant circuit to measure variables needed for assessing the charge level in refrigerant vapor compression system 10. The sensor 20 is disposed in operative association with the refrigerant circuit to measure the refrigerant liquid pressure, $P_{liquid}$, in the refrigerant circuit at or closely downstream with respect to refrigerant flow of the outlet of the condenser coil 12. The sensor 30 is disposed in operative association with the refrigerant circuit to measure the refrigerant liquid temperature, $T_{liquid}$, downstream with respect to refrigerant flow of the outlet of the condenser coil 12 and upstream with respect to refrigerant flow of the expansion valve 13.

The pressure sensor 20 may be a conventional pressure measuring device, such as for example a pressure transducer, and the temperature sensor 30 may be a conventional temperature sensor, such as for example a thermocouple, thermistor, or the like, mounted on the refrigerant line through which the refrigerant is circulating. The selection of the particular type of liquid line pressure sensor and liquid line temperature sensor employed is a matter of choice within the ordinary skill of the skilled practitioner in the art and is not limiting of or germane to the invention. The location of the liquid line pressure sensor 20 and the liquid line temperature sensor 30 is important. The liquid line pressure and temperature sensors 20, 30 must be located on the refrigerant line at a location in the refrigerant circuit whereat the refrigerant will normally be in a liquid state, not a vapor state or a mixed liquid/vapor state when the unit is operating when near or above normal refrigerant charge levels.

Figure 3A:
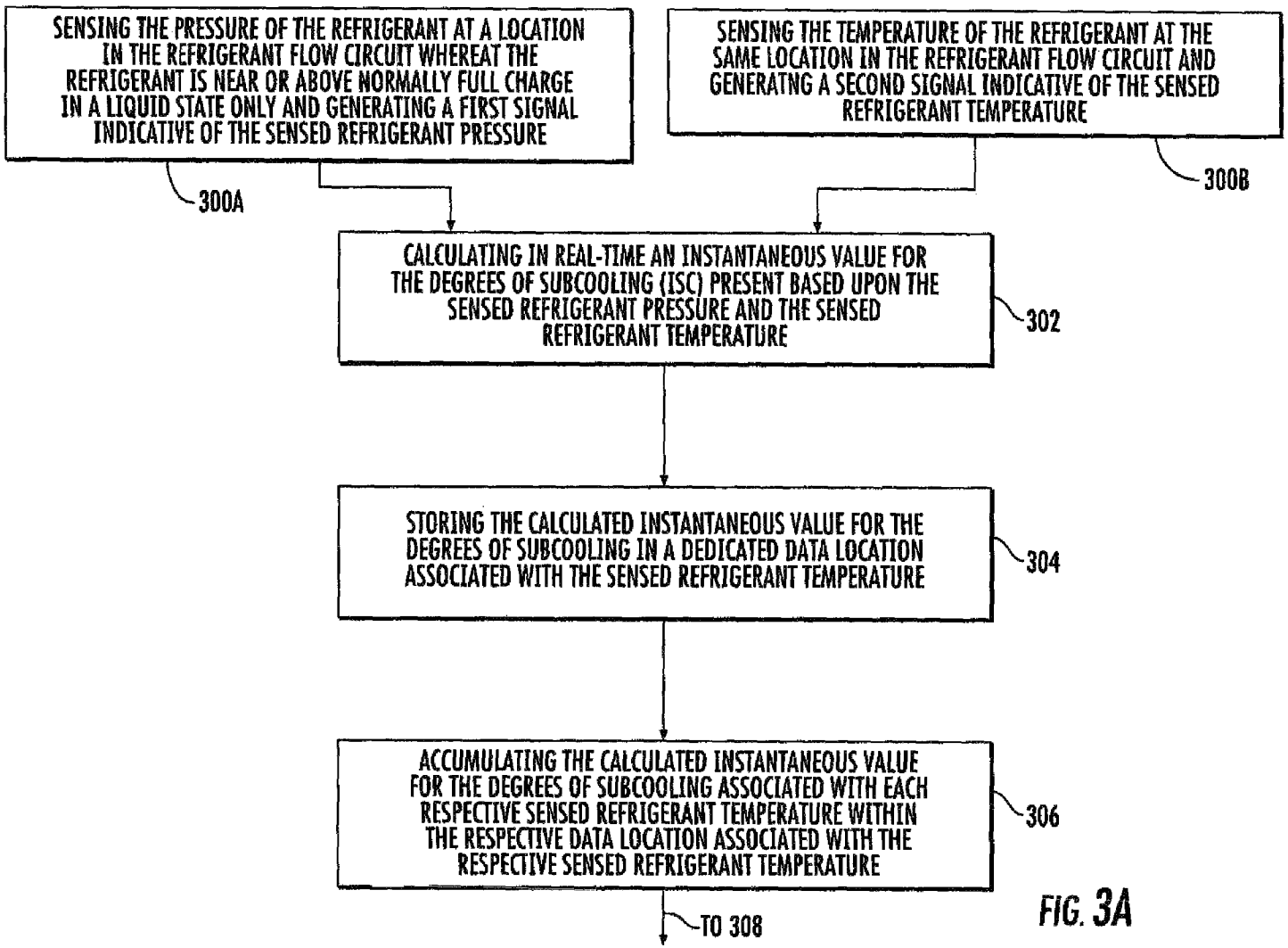
FIGS. 3A and 3B together form a process flow block diagram illustrating an embodiment of the method disclosed herein for indicating the level of refrigerant charge in a refrigerant vapor compression system.
Figure 3B:
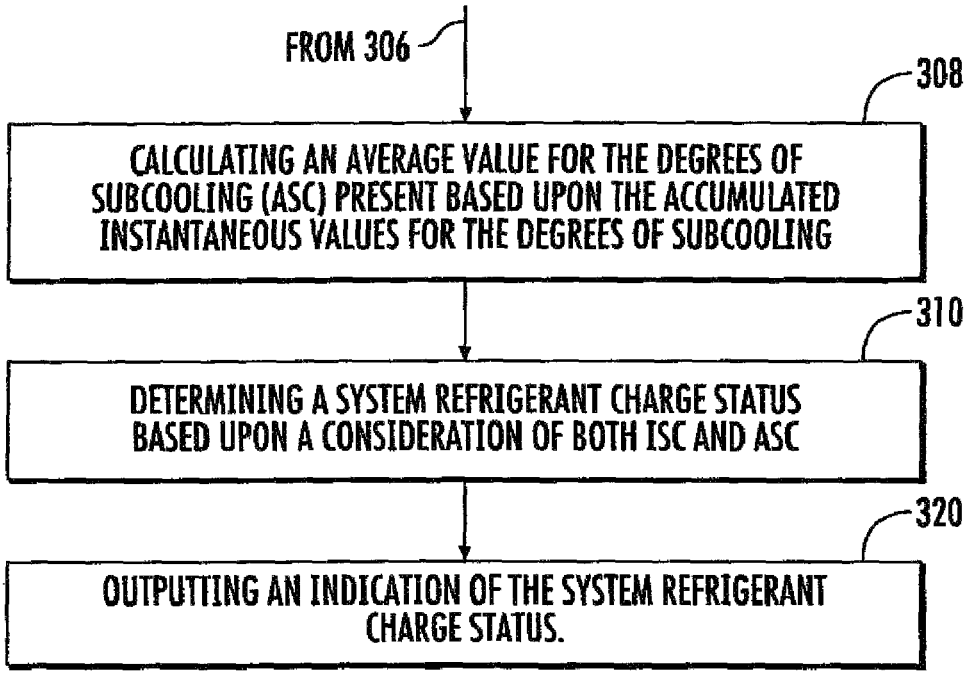

Referring now also to FIGS. 3A and 3B, there is depicted a process flow block diagram illustrating an exemplary embodiment of the method disclosed herein. In operation, the pressure sensor 20, at block 300A, generates and sends an analog voltage signal 21A to an analog-to-digital converter 22 indicative of the measured refrigerant liquid line pressure, $P_{liquid}$, and the temperature sensor 30, at block 300B, generates and sends an analog voltage signal 31A to an analog-to-digital converter 32 indicative of the measured refrigerant liquid line temperature, $T_{liquid}$. The analog-to-digital converter 22 converts the analog signal 21A received from the pressure sensor 20 into a digital signal 21D and outputs the resulting digital signal indicative of the measured refrigerant liquid line pressure to a microprocessor 40. Similarly, the analog-to-digital converter 32 converts the analog signal 31A received from the temperature sensor 30 into a digital signal 31D and outputs that digital signal indicative of the measured refrigerant liquid line temperature to the microprocessor 40.

The microprocessor 40 processes the digital output signals indicative of the measured refrigerant liquid line pressure and the refrigerant liquid line temperature and stores the processed data in a memory unit 42 in data communication with the microprocessor 40. The memory unit may be a ROM, an EPROM or other suitable data storage device. The memory unit 42 is preprogrammed with the pressure to temperature relationship charts characteristic of at least the refrigerant in use in the system 10. The microprocessor 40 reads the saturated liquid temperature, $T_{Lsat}$, for the refrigerant in use at the measured pressure, $P_{liquid}$. Knowing the saturated liquid temperature, at block 302, the microprocessor 40 calculates the actual degrees of subcooling, SC, using the following relationship:

$$SC=T_{Lsat}-T_{Liquid}.$$

The microcontroller 40 includes a plurality of designated data storage bins 43 for storing these calculated subcooling values with a separate data storage bin being designated to receive and store the data relating to a particular liquid line temperature. The microprocessor 40, at block 304, stores each calculated degrees of subcooling value in the memory unit 42 in the respective bin designated for data obtained at the respective measured refrigerant liquid line temperature at which that subcooling value was calculated.

As the ambient operating conditions, e.g. outdoor temperature, outdoor humidity, indoor temperature and indoor humidity, etc., the amount of subcooling present at any given time during operation of the system 10 will vary over time. If these operating conditions vary widely, the amount of subcooling experienced during operation of the system 10 will also vary over a wide range. Thus, the amount of subcooling at any given point of operation may not be reflective of the true adequacy or inadequacy of the refrigerant charge over the full range of operating conditions experienced by the system 10 over a period of time.

Accordingly, at periodic time intervals during system operation, the microprocessor 40 gathers the output signals from the aforementioned sensors processes the signals received to calculate the subcooling value as hereinbefore described. Over time, the microprocessor 40, at block 306, stores a plurality of subcooling values for each respective value of liquid line temperature in the designated data storage bin for that value of liquid line temperature. To ensure an accurate subcooling calculation, the microprocessor 40 only processes data gathered from the aforementioned sensors when the system 10 is operating in a steady-state condition at any particular point in operation. Therefore, the microprocessor 40 is configured to monitor the rate of change of each of the received signals from the analog-to-digital converters 22 and 32 associated respectively with the sensors 20 and 30 to filter out transient data.

When the rate of change of each of the signals 21D, and 31D drops below a preselected threshold indicative of steady-state operation, the microprocessor 40 will then process the received signals to calculate the degrees of subcooling at the measured liquid line temperature at the current system operating conditions and stores that calculated subcooling value in the respective storage bin associated with the measured liquid line temperature. Each storage bin is provided with a limited number of storage points and the data stored in each storage bin is arranged in a conventional "ring" fashion. In this arrangement, once all storage points within the bin have been filled, the next subcooling value received for storage in that particular bin will replace the oldest in time subcooling value stored therein. Therefore, only the most current data will be used in determining the adequacy of the refrigerant charge present in the system 10. Additionally, a memory reset device, for example a momentary switch, may be provided to clear all the subcooling values and related data from the data storage bins. At the discretion of the service technician, the memory reset device maybe activated to clear the microprocessor memory after the system has been serviced, the refrigerant charge adjusted as needed or when a system fault has occurred which renders the stored subcooling history unwanted. Clearing the microprocessor memory prevents old or unreliable subcooling values and other data from influencing future charge adequacy determinations after the system has been serviced.

To further ensure the accuracy of the refrigerant charge adequacy determinations, the microprocessor 40 uses liquid line temperature signal 21D as an indicator of the outdoor ambient air temperature. If the liquid line temperature drops below a preselected first low temperature threshold value, for example 70° F., the microprocessor 40 uses a wider threshold tolerances to determine satisfactory refrigerant charge. If the liquid line temperature drops below a second lower threshold value, for example 55° F., the received data is not stored or processed and the microprocessor 40 will not perform any subcooling calculations.

In addition to storing the calculated "instantaneous" subcooling values in association with the sensed liquid line temperature at a particular point of operation, the microprocessor 40 also includes a conventional control circuit for integrating the stored instantaneous values of degrees of subcooling over a selected period of time to provide an average amount of subcooling over that selected time period. The microprocessor 40, at block 308, calculates the average subcooling (ASC) value associated with that particular liquid line temperature (LLT) based upon all the instantaneous subcooling values stored within that respective bin.

In the method of the invention, the microprocessor uses both the instantaneous subcooling and the average subcooling values in determining the adequacy of the system's refrigerant charge at block 310, and otputs anindication of the system refrigerant charge status at block 320. To determine level of charge adequacy, the microprocessor 40 compares the calculated instantaneous subcooling (ISC) value to a first target value, TARI, and also compares the calculated average subcooling value to a second target value, TARA. For the refrigerant charge to be deemed adequate, the calculated instantaneous subcooling value must lie within a specified tolerance, TOLI, of the first target value, TARI, and the calculated average subcooling value must lie within a specified tolerance, TOLA, of the second target valve, TARA. In an embodiment of the method of the invention, TARI and TARA are the same value, and TOLI is greater than TOLA, that is the tolerance TOLI associated with the instantaneous subcooling value is relatively wider than the tolerance TOLA associated with the average subcooling value.

As discussed, the refrigerant charge in the system 10 is deemed adequate, i.e. correct, if, and only if, both the calculated instantaneous subcooling value and the calculated average subcooling value are within their respective tolerance of their respective target subcooling value. If the average subcooling value falls below the value of TARA−TOLA and/or the instantaneous subcooling valve falls below the value of TARI−TOLI, the refrigerant charge is deemed low, i.e. an undercharge condition exists. However, if the average subcooling value is above the value of TARA+TOLA and/or the instantaneous subcooling valve is above the value of TARI+TOLI, the refrigerant charge is deemed high, i.e. an overcharge condition exists.

Figure 4:
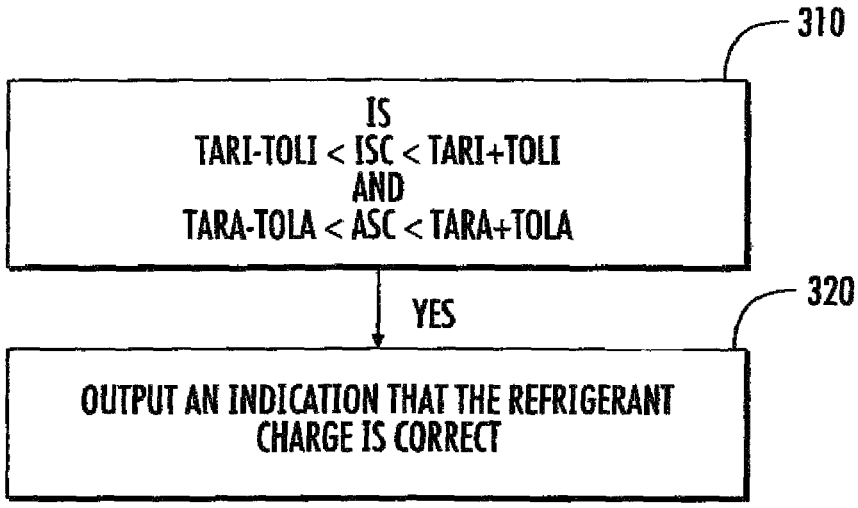
FIG. 4 is a process flow block diagram illustrating an embodiment of determining a system refrigerant charge status and outputting an indication of the system refrigerant charge status in accordance with the method disclosed herein.
Figure 5:
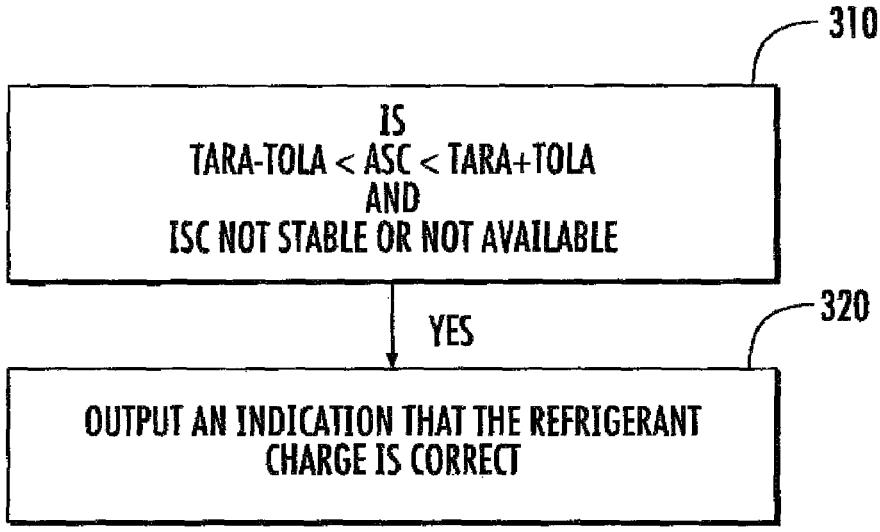
FIG. 5 is a process flow block diagram illustrating another embodiment of determining a system refrigerant charge status and outputting an indication of the system refrigerant charge status in accordance with the method disclosed herein.

In the embodiment depicted in FIG. 1, the microprocessor 40 communicates with a charge status indicator panel 60 having a series of indicators, such as lights 62, 64 and 66, one of which is associated with an undercharge or low charge condition, one of which is associated with an overcharge or high charge condition, and one of which is associated with an adequate or correct charge condition. Referring now to Table I and FIGS. 4-7, if the average subcooling value is greater than TARA−TOLA and also less than TARA+TOLA, and the instantaneous subcooling value is greater than TARI−TOLI and also less than TARI+TOLL, as in Condition IF, as depicted at block 310 in FIG. 4, at block 320, the microprocessor 40 will illuminate LED 64 indicating that the refrigerant charge is correct. The microprocessor 40 will, as depicted in FIG. 5, also illuminate LED 64 at block 320 to indicate a correct refrigerant charge under condition A when at block 310 the average subcooling value is greater than TARA−TOLA and also less than TARA+TOLA, but the instantaneous subcooling value is unstable, and under condition J when no average subcooling value is available because the date storage bin for the current liquid line temperature is not full, but the instantaneous subcooling value is greater than TARI−TOLI and also less than TARI+TOLI.

Figure 6:
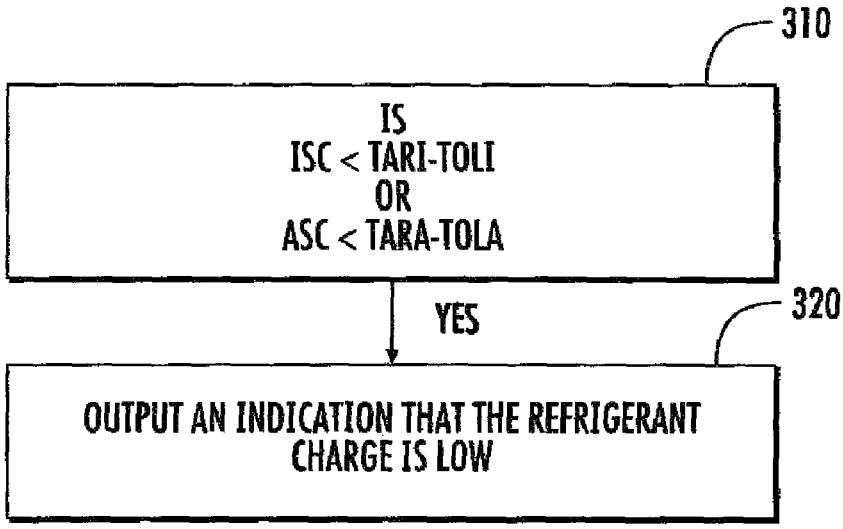
FIG. 6 is a process flow block diagram illustrating another embodiment of determining a system refrigerant charge status and outputting an indication of the system refrigerant charge status in accordance with the method disclosed herein.
Figure 7:
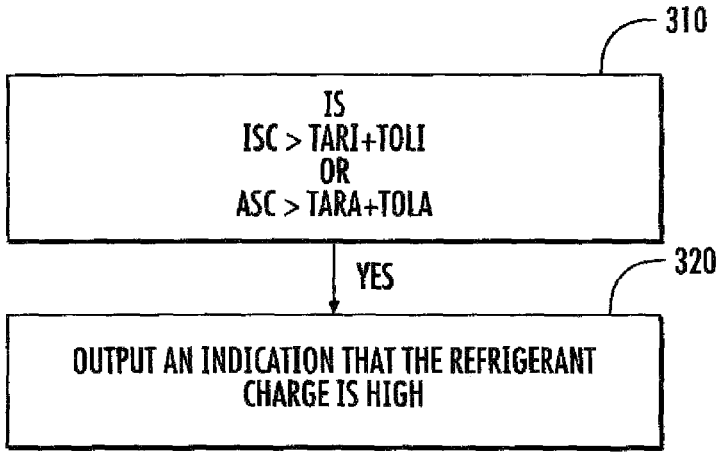
FIG. 7 is a process flow block diagram illustrating another embodiment of determining a system refrigerant charge status and outputting an indication of the system refrigerant charge status in accordance with the method disclosed herein.

Referring now to FIG. 6, at block 310, if the average subcooling value is less than TARA−TOLA, irrespective of the value of the instantaneous cooling, as in conditions B and D, or the instantaneous subcooling value is less than TARI−TOLI, irrespective of the value of the average subcooling, as in conditions E and I, the microprocessor 40 will, at block 320, illuminate LED 62 indicating that the refrigerant charge is low. Conversely, referring now to FIG. 7, if at block 310 the average subcooling value is greater than TARA+TOLA, as in conditions C and H, or if the instantaneous subcooling value is greater than TARI+TOLI, as in conditions G, H and K, the microprocessor 40 will, at block 320, illuminate LED 66 indicating that the refrigerant charge is high. Additionally, the microprocessor 40 will flash both LEDs 62 and 66 in the event, as in condition L, that the ambient temperature drops below a prespecified temperature, such as for example 55° F.

Figure 2:
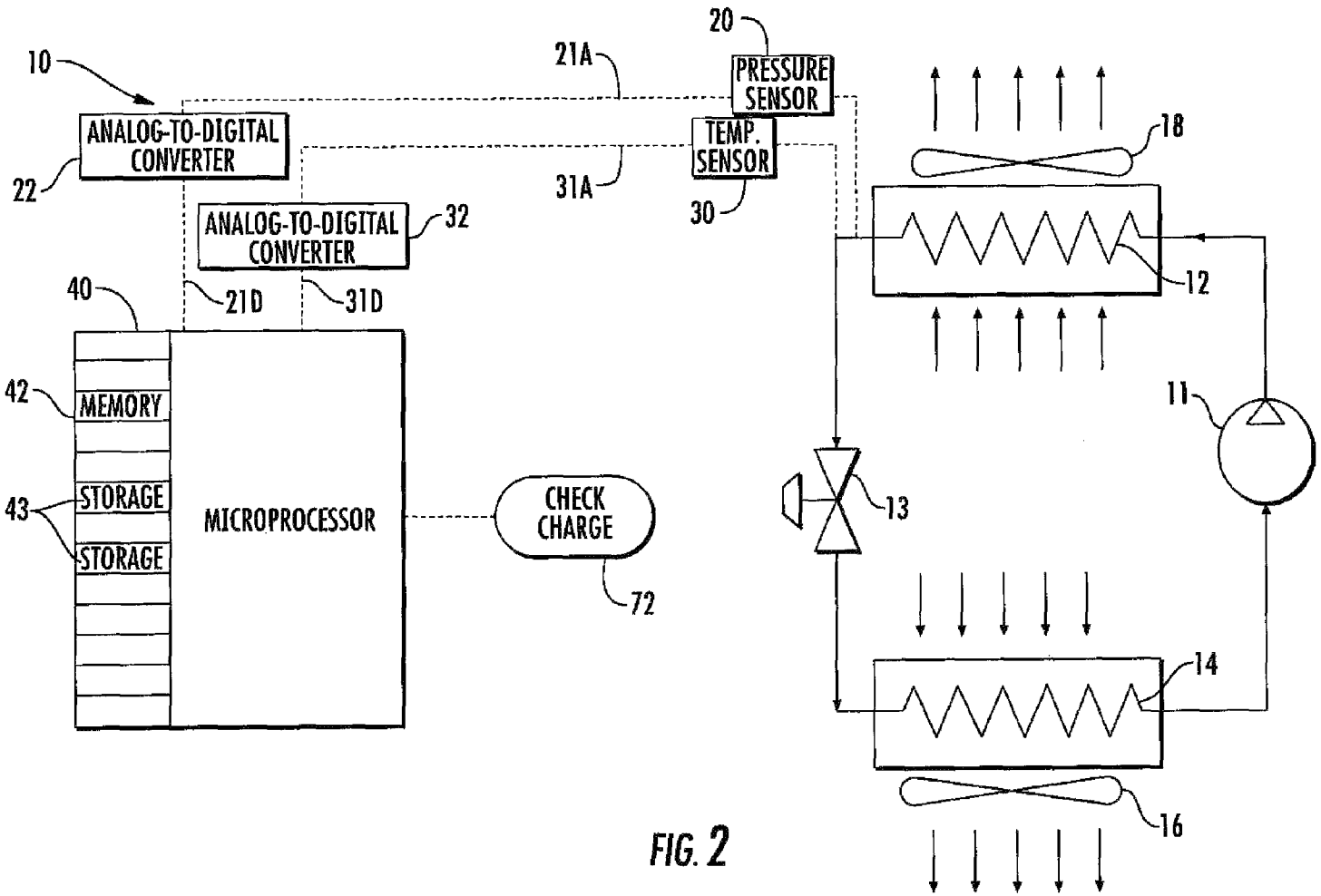
FIG. 2 is a schematic illustration of a second exemplary embodiment of the present invention.

In the embodiment depicted in FIG. 2, the microprocessor 40 communicates with a single alert light, such as LED 72, to indicate that the system refrigerant charge should be checked. In an embodiment, the light 72 may be mounted on a service panel of the air conditioning unit. In an embodiment, the light 72 may be mounted on a thermostat within a residence or commercial establishment to alert the owner that a service technician should be called to check the service charge. The microprocessor illuminates the light 72 if, and only if, the microprocessor 40 determines the refrigerant charge to be either low or high, that is if an undercharge or overcharge condition exists.

TABLE I

Output of the processor - complicated:

| Condition | Processor Evaluation* | LED Output |
|---|---|---|
| A | ISC Not Stable<br>ASC > TARA − TOLA<br>ASC < TARA + TOLA | Correct LED flashing |
| B | ISC Not Stable<br>ASC < TARA − TOLA | Low LED flashing |
| C | ISC Not Stable<br>ASC > TARA + TOLA | High LED flashing |
| D | ISC Stable<br>ASC < TARA − TOLA<br>ISC <=> TARI ± TOLI | Low LED Illuminated |
| E | ISC Stable<br>ASC > TARA − TOLA<br>ASC < TARA + TOLA<br>ISC < TARI − TOLI | Low LED flashing |

TABLE I-continued

| Output of the processor - complicated: | | |
|---|---|---|
| Condition | Processor Evaluation* | LED Output |
| F | ISC Stable<br>ASC > TARA − TOLA<br>ASC < TARA + TOLA<br>ISC > TARI − TOLI<br>ISC < TARI + TOLI | Correct LED Illuminated |
| G | ISC Stable<br>ASC > TARA − TOLA<br>ASC < TARA + TOLA<br>ISC > TARI + TOLI | High LED flashing |
| H | ISC Stable<br>ASC > TARA + TOLA<br>ISC > TARI + TOLI | High LED Illuminated |
| I | ISC Stable<br>Current liquid line Data bin not full<br>ISC < TARI − TOLI | Low LED flashing |
| J | ISC Stable<br>Current liquid line Data bin not full<br>ISC > TARI − TOLI<br>ISC < TARI + TOLI | Correct LED flashing |
| K | ISC Stable<br>Current or liquid line Data bin not full<br>ISC > TARI + TOLI | High LED flashing |
| L | LLT < 55° F. (or other T) | Low and High LED flashing in unison |

*Logical statement within each block are treated as logic "and"

Figure 8:
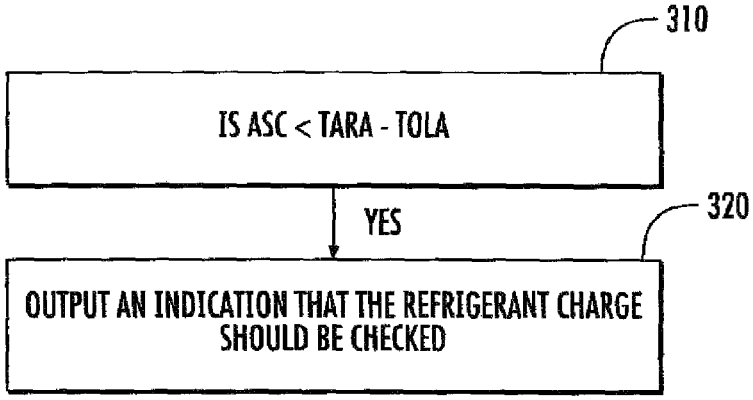
FIG. 8 is a process flow block diagram illustrating another embodiment of determining a system refrigerant charge status and outputting an indication of the system refrigerant charge status in accordance with the method disclosed herein.
Figure 9:
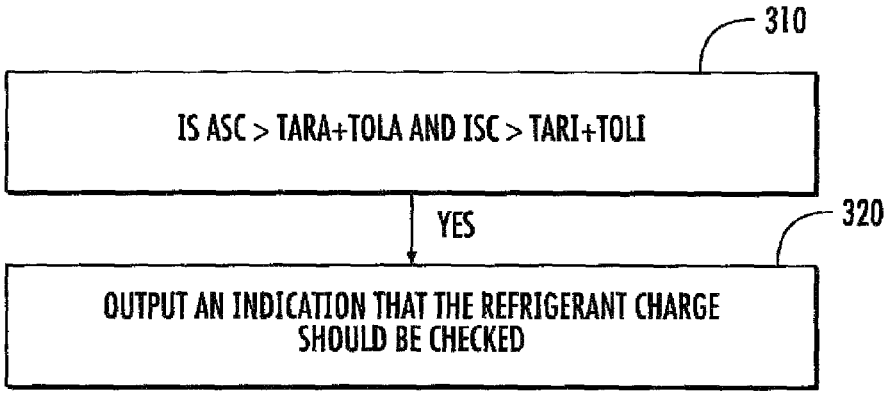
FIG. 9 is a process flow block diagram illustrating another embodiment of determining a system refrigerant charge status and outputting an indication of the system refrigerant charge status in accordance with the method disclosed herein.

Referring now to Table H and FIGS. 8 and 9, if the average subcooling value is either less than TARA−TOLA, as depicted at block 310 of FIG. 8, and the a stable instantaneous subcooling value exists, irrespective of its value, as in condition D, or, as depicted at block 310 of FIG. 9, the average subcooling value is greater than TARA+TOLA and the instantaneous subcooling value is greater than TARI+TOLI, as in condition H, the microprocessor will, at block 320, illuminate the LED 72 to indicate that the system refrigerant charge should be checked. Under all other conditions presented in Table 11, the microprocessor will not cause the light 72 to be illuminated.

TABLE II

| Output of the processor - simplistic (single "Check Charge" LED): | | |
|---|---|---|
| Condition | Processor Evaluation* | LED Output |
| A | ISC Not Stable<br>ASC > TARA − TOLA<br>ASC < TARA + TOLA | No Output |
| B | ISC Not Stable<br>ASC < TARA − TOLA | No Output |
| C | ISC Not Stable<br>ASC > TARA + TOLA | No Output |
| D | ISC Stable<br>ASC < TARA − TOLA<br>ISC <=> TARI ± TOLI | Check Charge LED Illuminated |
| E | ISC Stable<br>ASC > TARA − TOLA<br>ASC < TARA + TOLA<br>ISC < TARA − TOLI | No Output |
| F | ISC Stable<br>ASC > TARA − TOLA<br>ASC < TARA + TOLA<br>ISC > TARI − TOLI<br>ISC < TARI + TOLI | No Output |
| G | ISC Stable<br>ASC > TARA − TOLA<br>ASC < TARA + TOLA<br>ISC > TARI + TOLI | No Output |
| H | ISC Stable<br>ASC > TARA + TOLA<br>ISC > TARI + TOLI | Check Charge LED Illuminated |

TABLE II-continued

| Output of the processor - simplistic (single "Check Charge" LED): | | |
|---|---|---|
| Condition | Processor Evaluation* | LED Output |
| I | ISC Stable<br>Current liquid line Data bin not full<br>ISC < TARI − TOLI | No Output |
| J | ISC Stable<br>Current liquid line Data bin not full<br>ISC > TARI − TOLI<br>ISC < TARI + TOLI | No Output |
| K | ISC Stable<br>Current or liquid line Data bin not full<br>ISC > TARI + TOLI | No Output |
| L | LLT < 55° F. (or other T) | No Output |

*Logical statement within each block are treated as logic "and"

For a number of reasons, including human error, it is very difficult to charge a newly installed air conditioning system with the proper level of refrigerant charge. Thus, when initially charging a system, the field service technician will charge the system upon installation with an amount of refrigerant that results in a value for the degrees of subcooling that falls within a tolerance of a target value for degrees of subcooling at the current operating conditions. In a system incorporating the present invention, the microprocessor 40 will monitor the refrigerant liquid line pressure, the refrigeration liquid line temperature and the outdoor ambient air temperature to calculated the actual subcooling and provide an indication of the refrigeration charge adequacy based upon an analysis of the calculated subcooling values relative to preselected target subcooling values for that particular system. To ensure an accurate determination of refrigeration charge adequacy, the method of the present invention filters data from the sensors to eliminate non-steady state operating conditions from consideration, bases the average subcooling calculations on the most current data available, and takes both the instantaneous subcooling value and the average subcooling value into account in determining the adequacy of the system refrigeration charge.

While the present invention has been particularly shown and described with reference to a preferred embodiment as illustrated in the drawings, it will be understood by one skilled in the art that various changes in detail may be effected therein without departing from the true spirit and scope of the invention as defined by the claims. In particular, the present invention includes the equivalence of software and hardware in digital computing and the equivalence of digital and analog hardware in producing a particular output signal.

We claim:

1. A method for indicating the level of refrigerant charge in a refrigerant vapor compression system having a compressor, a condenser coil, an expansion device and an evaporator coil connected in serial relationship in refrigerant flow circuit, comprising the steps of sensing the pressure of the refrigerant at a location in the refrigerant flow circuit whereat the refrigerant is near or above normally full charge in a liquid state only and generating a first signal indicative of the sensed refrigerant pressure;

sensing the temperature of the refrigerant at the same location in the refrigerant flow circuit and generating a second signal indicative of the sensed refrigerant temperature;

calculating in real-time an instantaneous value for the degrees of subcooling present based upon the sensed refrigerant pressure and the sensed refrigerant temperature;

storing the calculated instantaneous value for the degrees of subcooling in a dedicated data location associated with the sensed refrigerant temperature;

accumulating the calculated instantaneous value for the degrees of subcooling associated with each respective sensed refrigerant temperature within the respective data location associated with the respective sensed refrigerant temperature;

calculating an average value for the degrees of subcooling present based upon the accumulated instantaneous values for the degrees of subcooling;

determining a system refrigerant charge status based upon a consideration of both the instantaneous value for the degree of subcooling and the average value for the degree of subcooling;

outputting an indication of the system refrigerant charge status.

2. A method as recited in claim 1 wherein the step of sensing the pressure of the refrigerant at a location in the refrigerant flow circuit whereat the refrigerant is in a liquid state only comprises sensing the pressure of the refrigerant leaving the condenser coil.

3. A method as recited in claim 1 wherein the step of sensing the temperature of the refrigerant at a location in the refrigerant flow circuit whereat the refrigerant is in a liquid state only comprises sensing the temperature of the refrigerant at a location downstream with respect to refrigerant flow of the condenser coil and upstream with respect to refrigerant flow of the expansion device.

4. A method as set forth in claim 1 wherein the step of determining a system refrigerant charge status includes the steps of:

determining whether the instantaneous subcooling value is within a first degrees of tolerance of a first target subcooling value; and determining whether the average subcooling value is within a second degrees of tolerance of a second target subcooling value.

5. A method as set forth in claim 4 wherein the first degrees of tolerance exceeds the second degrees of tolerance.

6. A method as set forth in claim 4 wherein the first subcooling target and the second subcooling target are the same degrees of subcooling.

7. A method as set forth in claim 1 wherein the step of outputting an indication of refrigerant charge status comprises indicating that the refrigerant charge should be checked.

8. A method as set forth in claim 7 further comprising outputting an indication of refrigerant charge status indicating that the refrigerant charge should be checked if both the instantaneous subcooling value is greater than an instantaneous subcooling target value plus a first degrees of tolerance and the average subcooling value is greater than an average subcooling target value plus a second degrees of tolerance.

9. A method as set forth in claim 7 further comprising outputting an indication of refrigerant charge status indicating that the refrigerant charge should be checked if the average subcooling value is less than the average subcooling target value minus the second degrees of tolerance.

10. A method as set forth in claim 1 wherein the step of outputting an indication of refrigerant charge status comprises the step of outputting an indication of whether the refrigerant charge status is low, high or correct.

11. A method as set forth in claim 10 wherein the step of outputting an indication of refrigerant charge status includes the step of outputting an indication that the refrigerant charge status is correct if the instantaneous subcooling value is greater than an instantaneous subcooling target value minus a first degrees of tolerance and less than the instantaneous subcooling target value plus the first degrees of tolerance and the average subcooling value is greater than an average subcooling target value minus a second degrees of tolerance and less than the average subcooling target value plus the second degrees of tolerance.

12. A method as set forth in claim 10 wherein the step of outputting an indication of refrigerant charge status includes the step of outputting an indication that the refrigerant charge status is correct if the average subcooling value is greater than an average subcooling target value minus a second degrees of tolerance and less than the average subcooling target value plus a second degrees of tolerance and the instantaneous subcooling value is not stable or not available.

13. A method as set forth in claim 10 wherein the step of outputting an indication of refrigerant charge status includes the step of outputting an indication that the refrigerant charge status is low if the instantaneous subcooling value is less than an instantaneous subcooling target value minus a first degrees of subcooling or if the average subcooling value is less than an average subcooling target value minus a second degrees of tolerance.

14. A method as set forth in claim 10 wherein the step of outputting an indication of refrigerant charge status includes the step of outputting an indication that the refrigerant charge status is high if the instantaneous subcooling value is greater than an instantaneous subcooling target value plus a first degrees of subcooling or if the average subcooling value is greater than an average subcooling target value plus a second degrees of tolerance.

* * * * *